US005941021A

United States Patent [19]

Valls, Jr. et al.

[11] Patent Number: 5,941,021

[45] Date of Patent: Aug. 24, 1999

[54] LOUVER-TYPE WINDOW AND SLAT THEREFOR

[75] Inventors: José E. Valls, Jr.; Salvador Vassallo, both of Ponce, Puerto Rico

[73] Assignee: Vassallo Research & Development Corporation, Coto Laurel, Puerto Rico

[21] Appl. No.: 08/743,815

[22] Filed: Nov. 6, 1996

[51] Int. Cl.[6] ..... E06B 7/08

[52] U.S. Cl. ..... 49/92.1; 49/403; 160/236

[58] Field of Search ..... 49/74.1, 79.1, 49/87.1, 91.1, 92.1, 51, 403; 52/309.11, 309.9; 160/236

[56] References Cited

U.S. PATENT DOCUMENTS

| | | | |
|---|---|---|---|
| 700,873 | 5/1902 | Wilson . | |
| 1,695,768 | 11/1928 | Kelly . | |
| 3,110,936 | 11/1963 | Berard | 20/62 |
| 3,130,458 | 4/1964 | Zacharias | 49/403 |
| 3,302,692 | 2/1967 | Grau | 49/92.1 |
| 3,540,154 | 11/1970 | Calusio | 49/91.1 |
| 3,771,559 | 11/1973 | Alley | 137/601 |
| 3,894,481 | 7/1975 | Alley | 49/92.1 |
| 4,042,005 | 8/1977 | Hammerstein | 160/220 |
| 4,057,936 | 11/1977 | Wyatt, Jr. et al. | 49/91.1 |
| 4,113,230 | 9/1978 | McCabe | 49/87.1 |
| 4,343,340 | 8/1982 | Paule | 160/232 |
| 4,382,460 | 5/1983 | Ben-Tal | 160/236 |
| 4,436,136 | 3/1984 | Downey, Jr. | 160/232 |
| 4,469,132 | 9/1984 | Redington | 49/91.1 |
| 4,497,134 | 2/1985 | Meyer et al. . | |
| 4,630,399 | 12/1986 | Okumoto | 49/403 |
| 4,630,664 | 12/1986 | Magro | 160/232 |
| 4,718,472 | 1/1988 | Hörmann | 160/229 R |
| 4,799,526 | 1/1989 | Reeves | 160/168.1 |
| 4,846,247 | 7/1989 | Kessler | 160/235 |
| 4,850,138 | 7/1989 | Watanabe et al. | 49/91.1 |
| 4,889,040 | 12/1989 | Man | 49/87.1 |
| 4,972,894 | 11/1990 | Machill | 160/235 |
| 4,979,553 | 12/1990 | Lowry, III et al. | 160/133 |
| 5,029,413 | 7/1991 | Jovanovic | 49/84 |
| 5,165,746 | 11/1992 | Teigen | 296/24.1 |
| 5,186,876 | 2/1993 | Purstinger et al. | 264/40.6 |
| 5,204,147 | 4/1993 | Schneider | 428/35.8 |
| 5,217,800 | 6/1993 | Pentecost | 428/283 |
| 5,343,924 | 9/1994 | Hoffman | 160/235 |
| 5,358,024 | 10/1994 | Schwaegerle | 160/236 |
| 5,419,386 | 5/1995 | Magro et al. | 160/232 |
| 5,435,108 | 7/1995 | Overholt et al. | 52/309.11 |
| 5,474,118 | 12/1995 | Hoffman | 160/235 |
| 5,496,630 | 3/1996 | Hawrylko et al. | 428/328 |
| 5,507,335 | 4/1996 | Yu | 160/235 |
| 5,514,325 | 5/1996 | Pürstinger | 264/560 |
| 5,515,902 | 5/1996 | Hoffman | 160/235 |
| 5,518,806 | 5/1996 | Eder et al. | 428/218 |
| 5,555,923 | 9/1996 | Leist et al. | 160/236 |

FOREIGN PATENT DOCUMENTS 339593 12/1930 United Kingdom .

*Primary Examiner*—Daniel P. Stodola
*Assistant Examiner*—Curtis A. Cohen
*Attorney, Agent, or Firm*—Roylance, Abrams, Berdo & Goodman, L.L.P.

[57] ABSTRACT

A slat for pivotally mounting between a pair of opposed frame members of an opening. The slat has an elongated member having first and second walls that are coupled together to form first and second longitudinally extending side edges and first and second end edges. First and second coupling members are coupled to the first and second side edges, respectively. The first and second coupling members have first and second coupling ledges spaced from the first and second side edges to form first and second longitudinally extending recesses. Each of the first and second recesses receive an adjacent coupling member on an adjacent slat, respectively. The first recess opens toward the first wall, while the second recess opens toward the second exterior wall. First and second support members are coupled to the first and second ends of the elongated member, respectively. Each of the first and second support members have a first pivot element, arranged to form a first pivot axis extending longitudinally between the first pivot elements for pivotally mounting the elongated member about the first pivot axis for movement between an open position and a closed position. The slat can be used in a louver-type window.

46 Claims, 8 Drawing Sheets

LOUVER-TYPE WINDOW AND SLAT THEREFOR

FIELD OF THE INVENTION

The invention relates to a louver-type window and slats therefore. More specifically, the invention relates to a plastic louver-type window made from extruded polyvinyl chloride ("PVC") material. A plurality of extruded slats are pivotable between a closed position and an open position with each slat having interior chambers capable of receiving insulating material and/or reinforcing bars.

BACKGROUND OF THE INVENTION

Louver-type windows are often used in tropical regions. They are easily opened to permit air and light to pass through, then easily closed during storms or at night.

Generally, conventional louver-type windows have slats made from aluminum, wood, or glass supported in a metal frame. However, these conventional louver-type windows have significant shortcomings. For example, conventional slats do not provide adequate insulation. Additionally, aluminum slats jam easily, and are typically noisy during operation. Wood slats, on the other hand, discolor and require on-going maintenance, while glass slats are easily broken.

While plastic slats have been used in roll-up doors and as interior window treatments, the use of plastic in louver-type windows has been limited. For example, U.S. Pat. No. 3,110,936 to Berard discloses plastic louver boards that are used merely as replacement boards in existing, conventional louver-type windows.

Other examples of prior art pivoting slats are disclosed in the following U.S. Pat. Nos.: 3,771,559 to Alley; and 4,382,460 to Ben-Tal.

Examples of prior art roll-up doors are disclosed in the following U.S. Pat. Nos.: 4,042,005 to Hamerstein; 4,343,340 to Paule; 4,436,136 to Downey, Jr.; 4,972,894 to Machill; 4,979,553 to Lowry, III et al.; 5,165,746 to Teigen; and 5,515,902 to Hoffman.

Examples of prior art pivoting blinds for use as interior window treatment are disclosed in the following U.S. Pat. Nos.: 4,799,526 to Reeves; 5,029,413 to Jovanovic.; and 5,496,630 to Hawrylko, et al.

SUMMARY OF THE INVENTION

Accordingly, an object of this invention is to provide a plastic louver-type window that is easily opened to permit air and light to pass through, and easily closed when conditions warrant.

Another object of this invention is to provide a louver-type window that is made from extruded plastic material to facilitate manufacturing.

Another object of this invention is to provide a plastic louver-type window that can be quietly and efficiently operated.

Still another of this invention is to provide slats for a louver-type window that contain insulating material.

Yet another object of this invention is to provide slats for a louver-type window that have a reinforcing bar for additional strength.

A further object of this invention is to provide a louver-type window that is formed from translucent plastic or from colored plastic to reduce the need for maintenance.

The foregoing objects are basically attained by providing a slat for pivotally mounting between a pair of opposed frame members of an opening. The slat has an elongated member with first and second exterior walls which are coupled together to form first and second longitudinally extending side edges and first and second end edges. First and second coupling members are coupled to the first and second side edges, respectively. The first and second coupling members have first and second coupling ledges spaced from the first and second side edges to form first and second longitudinally extending recesses. Each of the first and second recesses receives an adjacent coupling member on an adjacent slat, respectively. The first recess opens toward the first exterior wall and the second recess opens toward the second exterior wall. First and second support members are coupled to the first and second ends of the elongated member, respectively. Each of the first and second support members having a first pivot element, arranged to form a first pivot axis extending longitudinally between the first pivot elements for pivotally mounting the elongated member about said first pivot axis for movement between an open position and a closed position.

Other objects, advantages, and salient features of the invention will become apparent from the following detailed description, which, when taken in conjunction with the annexed drawings, discloses several preferred embodiments of the invention.

BRIEF DESCRIPTION OF THE DRAWINGS

Referring to the drawings which form a part of this disclosure.

DETAILED DESCRIPTION OF PREFERRED EMBODIMENTS

Figure 1:
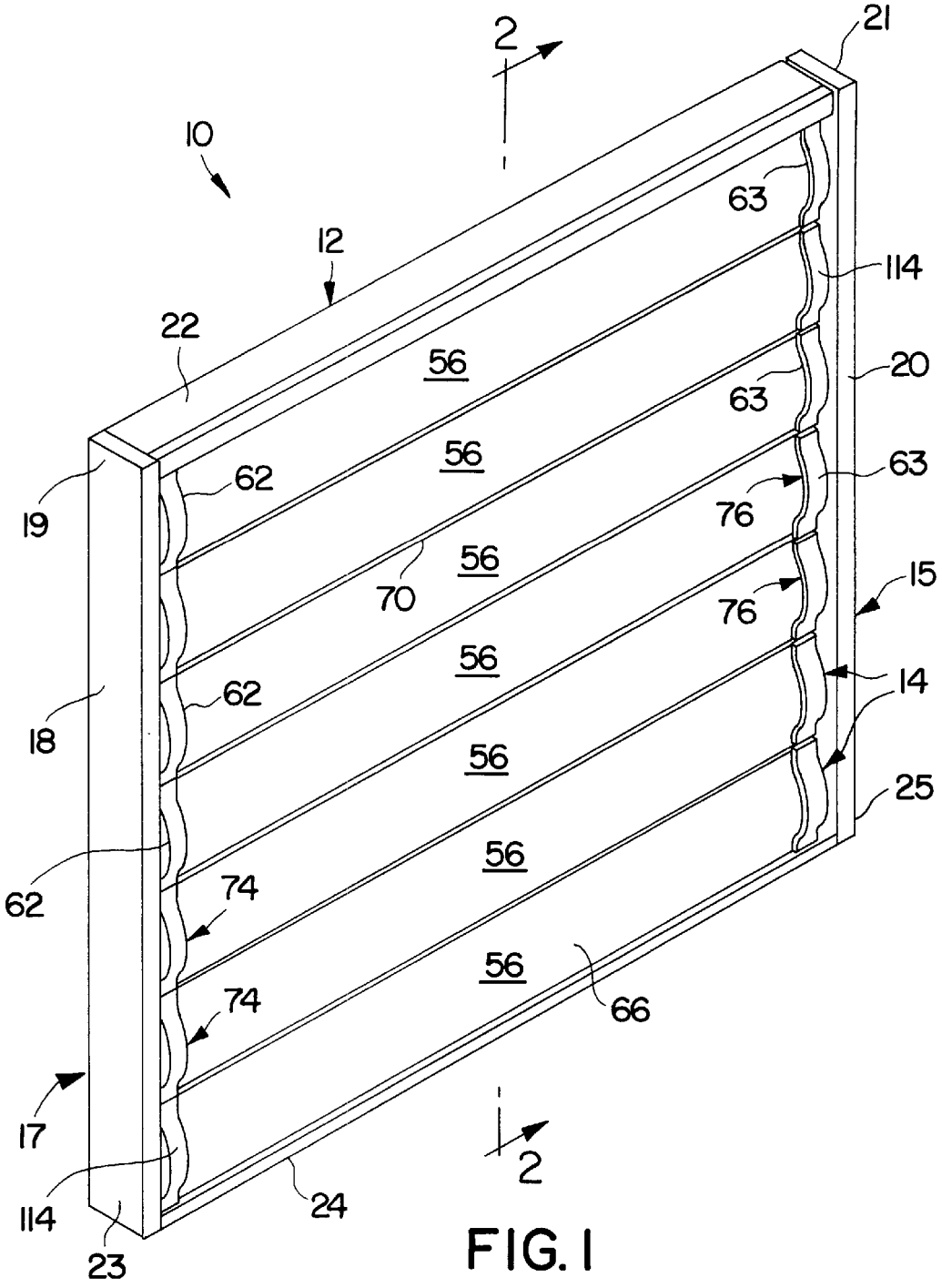
FIG. 1 is a perspective view of the louver-type window, in accordance with the present invention, in the closed position.

Referring initially to FIGS. 1–4, a louver-type window 10 in accordance with the present invention is illustrated, and basically includes a frame 12, a plurality of slats 14 extending within frame 12, and a pivoting mechanism 16. Slats 14 are pivotally coupled to and supported within frame 12 between a closed position (FIG. 2) and an open position (FIG. 4) by pivoting mechanism 16. Pivoting mechanism 16 is coupled to each of the slats 14 for simultaneously rotating each slat 14 relative to frame 12 between the closed and open positions. In the open position, window 10 allows light and air to pass between an environment adjacent an exterior surface 15 of window 10 and an environment adjacent an interior surface 17 of window 10.

Frame 12 has two opposed side members 18 and 20, a top member 22, and a bottom member 24. Frame 12 is generally rectangular with side members 18 and 20 being parallel, and top member 22 being parallel to bottom member 24. Top member 22 and bottom member 24 extend the entire distance between, and are rigidly attached to side members 18 and 20. Top member 22 extends between top ends 19 and 21 of side members 18 and 20, respectively, while bottom member 24 extends between bottom ends 23 and 25 of side member 18 and 20, respectively. Side members 18 and 20, top member 22, and bottom member 24 are all formed from extruded plastic material, such as PVC.

Figure 12:
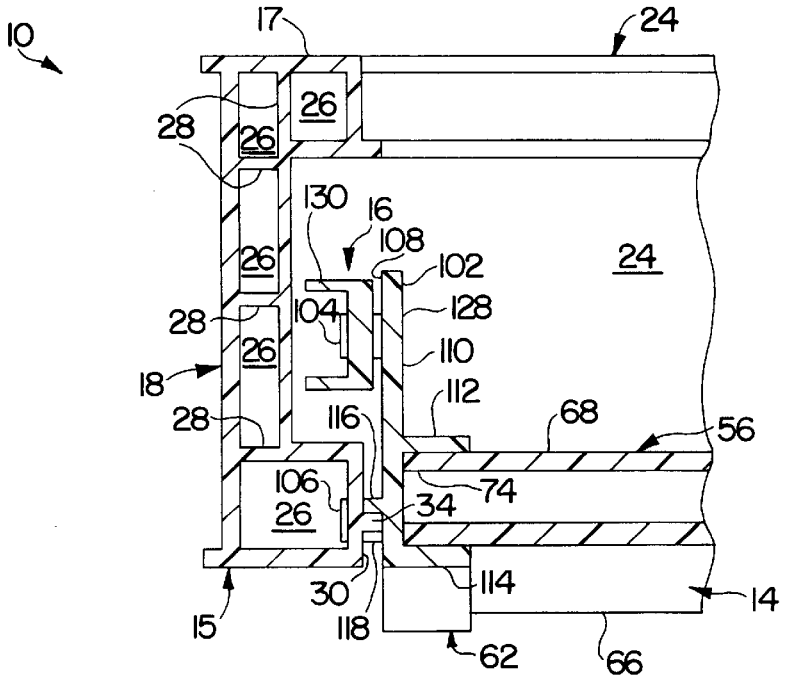
FIG. 12 is an enlarged, partial cross-sectional view of the louver-type window of FIGS. 1–5 taken along line 12—12 of FIG. 11.

Side members 18 and 20 of frame 12 are mirror images of each other. Therefore, only side member 18 will be discussed and illustrated in detail. As seen in FIG. 12, side member 18 is preferably integrally formed as a one-piece, unitary member and is generally U-shaped in horizontal cross-section with several hollow chambers 26 formed by internal ribs 28. Ribs 28 strengthen side member 18, while chambers 26 are filled with air to provide an insulating effect. Of course, it will be apparent to those skilled in the art from this disclosure that chambers 26 can be filled with a conventional insulating material such as a foam insulation.

Figure 3:
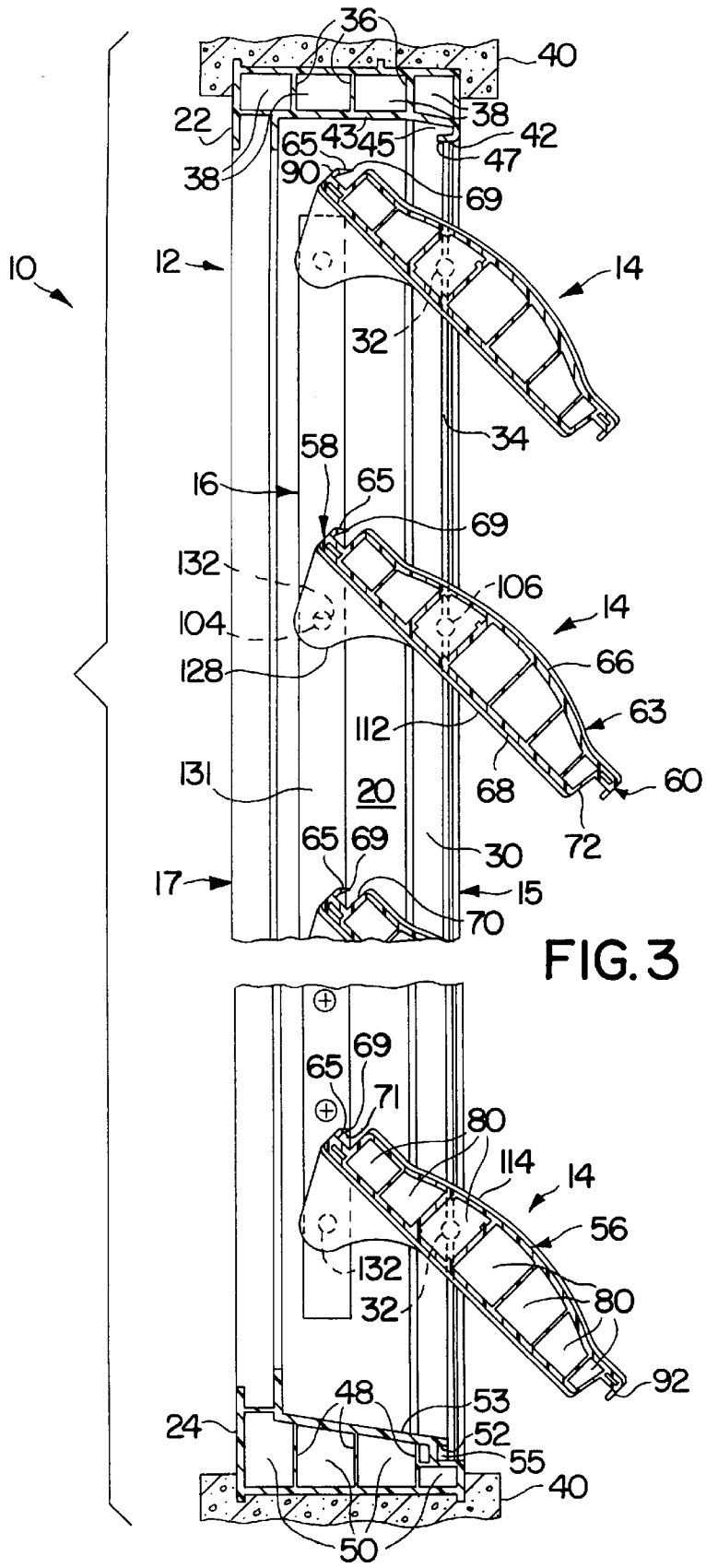
FIG. 3 is a side elevational view in section similar to FIG. 2, but showing the louver-type window, illustrated in FIGS. 1 and 2, in a partially-open position.
Figure 4:
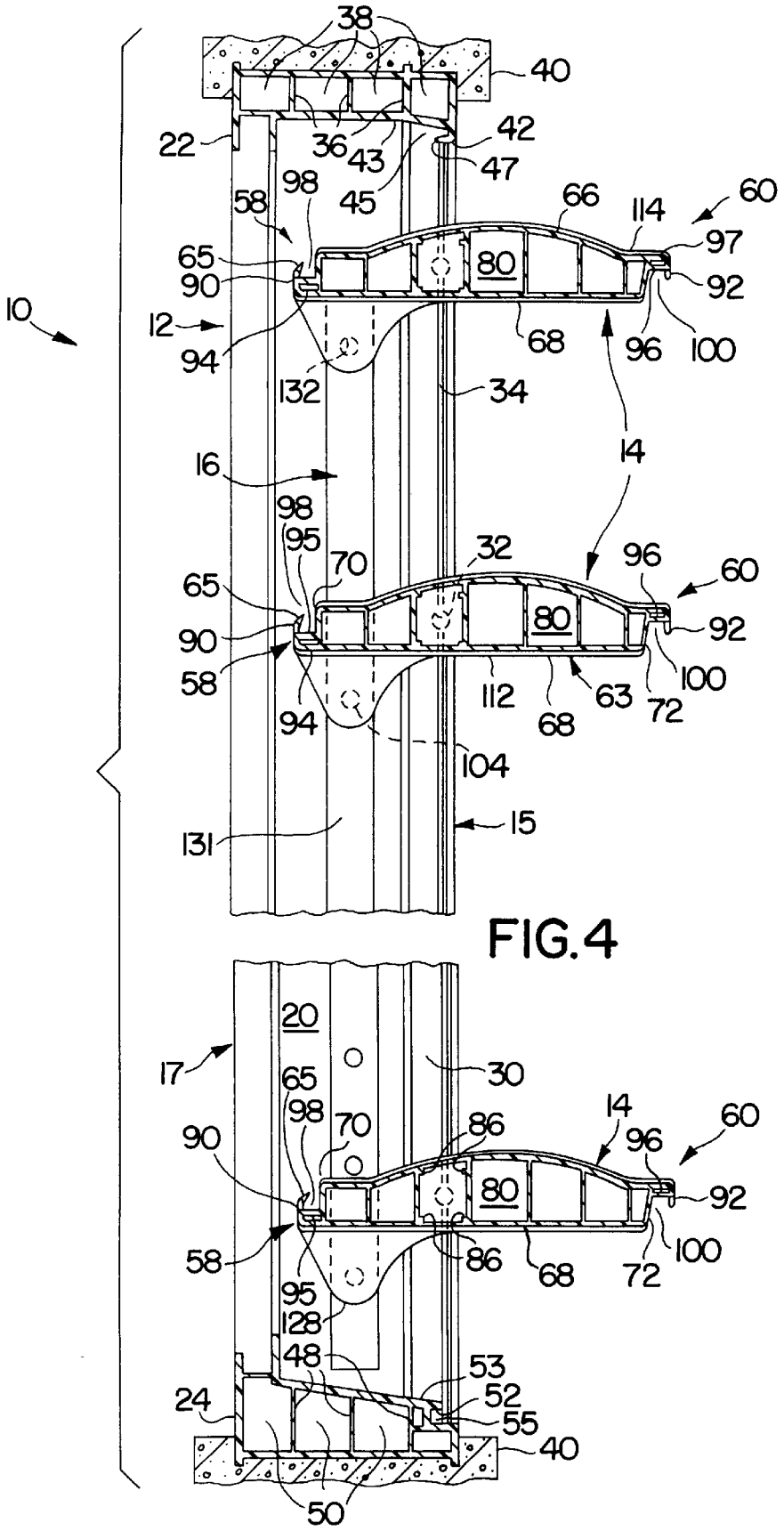
FIG. 4 is a side elevational view in section similar to FIG. 2, but showing the louver-type window, illustrated in FIGS. 1 and 2, in the open position.

As best seen in FIGS. 3, 4 and 12, a forward inner sidewall 30 of side member 18 extends the entire vertical length of side member 18 and has a plurality of apertures 32 extending therethrough. The number of apertures 32 preferably corresponds to the numbers of slats 14, each aperture 32 pivotally receives one end of one of the slats 14 as described below. A frame sealing rib 34 extends perpendicularly and outwardly from sidewall 30 along the entire vertical length of side member 18, except for where frame sealing rib 34 intersects apertures 32. Apertures 32 are centered on the longitudinal axis of frame sealing rib 34 and are spaced along sidewall 30 to correspond with each slat 14. Frame sealing rib 34 interacts with each slat 14 to provide a seal between each slat 14 and frame side member 18 as discussed below.

As seen in FIGS. 1–4, top member 22 is formed of one-piece construction, and is generally rectangular in cross-section with internal ribs 36 forming hollow chambers 38. Similar to the construction of side member 18, discussed above, ribs 36 strengthen top member 22, while chambers 38 provide an insulating effect. Of course, it will be apparent to those skilled in the art from this disclosure that chambers 38 can be filled with a conventional insulating material such as a foam insulation.

Top member 22 has a downwardly extending ledge 42 for coupling and sealing the uppermost or top slat 14 to top member 22. Ledge 42 is part of the one-piece construction of top member 22, and extends downwardly from a lower surface 43 of top member 22. Ledge 42 is hook-shaped to form a recess 45 which opens in the direction of the interior surface 17 of window 10. Ledge 42 is arranged such that the coupling between top member 22 and top slat 14 is identical to the coupling between adjacent slats 14 as described below.

Bottom member 24 of frame 12 is also of one-piece construction and is generally trapezoidal in cross-section. Bottom member 24 has internal ribs 48 forming chambers 50 similar to those in side members 18 and 20 and in top member 22. Also, an integrally formed sealing ledge 52 projects outwardly from an upper surface 53 of bottom member 24 to form a recess 55 for coupling with the lowermost or bottom slat 14 that is adjacent bottom member 24. Recess 55 opens toward the exterior surface 15 of window 10 to receive the bottom slat 14. Ledge 52 is arranged so that the coupling between bottom member 24 and the bottom slat 14 is similar to the coupling between adjacent slats 14 as discussed below. The only difference being that the coupling between bottom member 24 and the bottom slat 14 occurs without the use of a sealing element or gasket 64.

Figure 2:
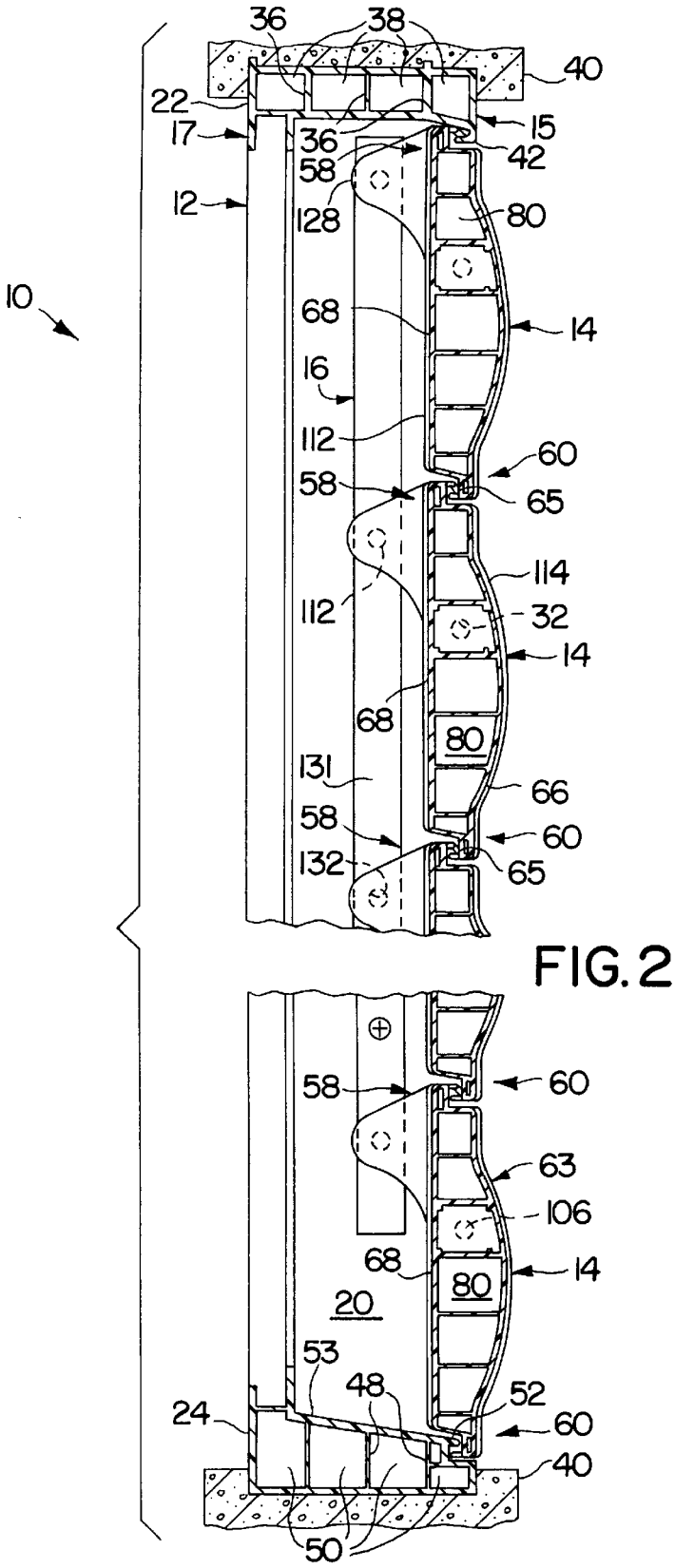
FIG. 2 is a side elevational view in section taken along line 2—2 of FIG. 1, and further including the abutments into which the window is secured.

As seen in FIGS. 2–4, top and bottom members 22 and 24 can be installed in and supported by concrete 40. Although concrete 40 is shown as supporting only top member 22 and bottom member 24, side members 18 and 20 can also be installed in concrete 40 in a similar manner. Additionally, although the support for frame 12 is shown as concrete, other supporting materials can be used. For instance, frame 12 can be supported by wood, or any other building material. Further, although window 10 is useful in buildings, window 10 can be used wherever windows are employed (e.g., doors). Still further, window 10 may be used wherever it is desirable to selectively open and close through-holes (e.g., vents).

As seen in FIGS. 1–4, each slat 14 is formed of an elongated member 56, an upper coupling member 58, a lower coupling member 60, a pair of support members or end caps 62 and 63, and a sealing element or gasket seal 65. Each slat 14 extends perpendicularly to side members 18 and 20, while extending completely across frame 12 between side members 18 and 20.

As seen in FIGS. 1 and 6–8, each elongated member 56 has a curved, protruding outer wall 66, a substantially flat inner wall 68, an upper side edge 70, a lower side edge 72, a pair of end edges 74 and 76, and a plurality of interior ribs 78 dividing the interior of elongated member 56 into a plurality of interior chambers 80. Elongated member 56 is extruded from plastic material, such as PVC, as a one-piece, unitary member.

Walls 66 and 68 of elongated member 56 are joined together at upper and lower side edges 70 and 72. Side edges 70 and 72 extend longitudinally the entire length of elongated member 56. Upper side edge 70 is preferably substantially perpendicular to inner wall 68, while lower side edge 72 is preferably slightly angled in a non-perpendicular manner with inner wall 68.

End edges 74 and 76 are located at opposite ends of elongated member 56 adjacent side members 18 and 20 of frame 12, respectively. End edges 74 and 76 have end caps 62 and 63 press-fitted over end edges 74 and 76 for fixedly coupling them thereto. Alternatively, end caps 62 and 63 can be fixedly coupled thereto via an adhesive or other conventional fastening means.

Interior ribs 78 extend between outer and inner walls 66 and 68 along the entire length of elongated member 56. Ribs 78 are preferably substantially perpendicular to inner exterior wall 68. Ribs 78 provide added strength to elongated member 56 and form hollow interior chambers 80 that extend completely through elongated member 56 between end edges 74 and 76. Although ribs 78 and walls 66 and 68 are shown as being relatively thin compared to chambers 80, exterior walls 66 and 68 and ribs 78 may have an increased thickness for increased strength, depending on the desired characteristics of slats 14.

As seen in FIGS. 2–4, a first embodiment of each elongated member 56 shows chambers 80 filled with air for insulating purposes. This embodiment is particularly suited for elongated members 56 formed from translucent plastic material since light may pass through window 10 regardless of the position of slats 14.

Figure 6:
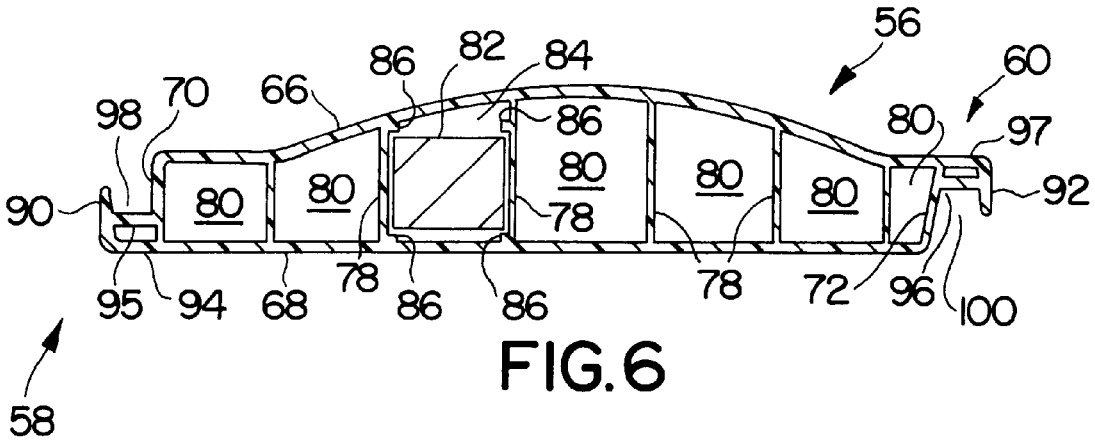
FIG. 6 is a side elevational view in section of a second embodiment of the elongated member in accordance with the present invention.
Figure 7:
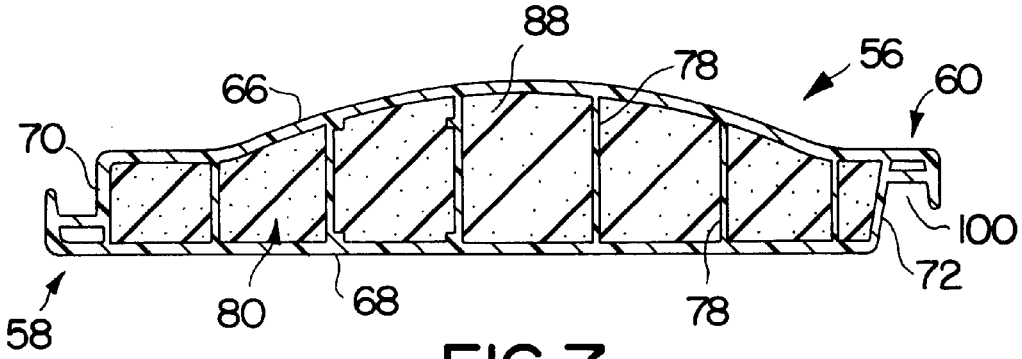
FIG. 7 is a side elevational view in section of a third embodiment of the elongated member in accordance with the present invention.
Figure 8:
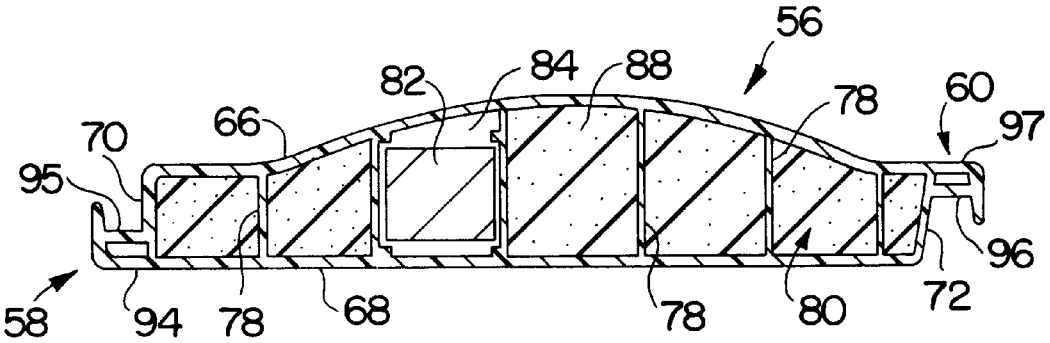
FIG. 8 is a side elevational view in section of a fourth embodiment of the elongated member in accordance with the present invention.
Figure 9:
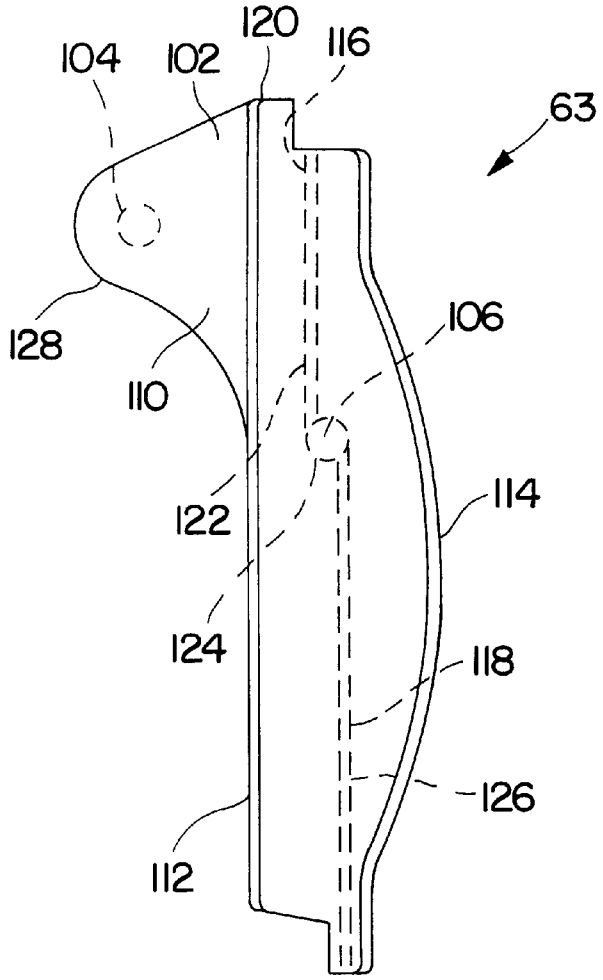
FIG. 9 is a side elevational view of an end cap in accordance with the present invention.
Figure 10:
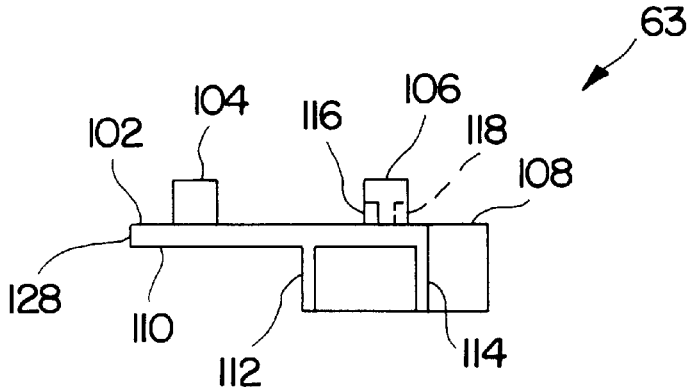
FIG. 10 is a top plan view of an end cap in accordance with the present invention.

As seen in FIGS. 6–8, chambers 80 can be filled with various materials to tailor slat 14 for desired characteristics. These materials are inserted into chambers 80 through end edges 74 and 76.

FIG. 6 shows a second embodiment of elongated member 56 having a reinforcing bar 82 inserted within central chamber 84. Bar 82 extends along the entire length of elongated member 56. Central chamber 84 is formed by two ribs 78 having bar supports 86 formed thereon, which extend into central chamber 84 to snugly secure bar 82 along its length. Although only one bar 82 is shown, multiple bars supported similar to bar 82 may be utilized in the remaining chambers 80, as desired or needed. Furthermore, although bar 82 is preferably made of a metal, such as steel, other materials can be used. For instance, a hard plastic or composite material of sufficient strength can be used.

As seen in FIG. 7, a third embodiment of elongated member 56 is shown with chambers 80 being filled with an insulating material 88. Insulating material 88 may be foam insulation or any other commonly used insulating material. Insulating material 88 may be blown or slid into chambers 80 depending on the type of insulation used.

As seen in FIG. 8, a fourth embodiment of elongated member 56 provides for both increased insulation and increased strength. Both reinforcing bar 82 and insulating material 88 are used together within chambers 80. Although only one reinforcing bar 82 is shown, multiple reinforcing bars 82 may be utilized in multiple chambers 80, with other chambers 80 filled with insulating material 88.

As seen in FIGS. 5–8, upper coupling member 58 has an upper coupling ledge 90, and inner and outer ledge supports 94 and 95, respectively. Ledges 90, 94 and 95 together with upper side edge 70 forms an upper recess 98. Likewise, lower coupling member 60 has a lower coupling ledge 92, inner and outer ledge supports 96 and 97, respectively, and a lower recess 100. Upper coupling member 58 and lower coupling member 60 extend outwardly from upper side edge 70 and lower side edge 72, respectively.

Upper coupling member 58 of each slat 14 is designed to engage with lower coupling member 60 of an adjacent slat 14, and vice versa, except for the top and bottom slats 14 which engage ledges 42 and 52. Accordingly, coupling members 58 and 60 interlock slats 14 together and to top and bottom members 22 and 24. Moreover, coupling members 58 and 60 create a seal between adjacent slats 14 and between top and bottom members 22 and 24. In the preferred embodiment, side edges 70 and 72, ledge supports 94, 95, 96 and 97 and coupling ledges 90 and 92 are made integrally as a one-piece, unitary element with elongated member 56.

Inner and outer ledge supports 94 and 95 both extend between and are perpendicular to upper side edge 70 and upper coupling ledge 90. Upper coupling ledge 90 is parallel to upper side edge 70 and extends away from outer ledge support 95. Upper recess 98 is formed by upper side edge 70, upper ledge support 95, and upper coupling ledge 90 and opens towards outer exterior wall 66.

Inner and outer ledge supports 96 and 97 both extend between lower side edge 72 and lower coupling ledge 92. Ledge supports 96 and 97 extend parallel to Inner exterior wall 68, and perpendicularly to lower coupling ledge 92. Ledge supports 96 and 97 extend in an angularly, non-perpendicular fashion with respect to lower side edge 72.

Lower coupling ledge 92 extends away from inner ledge support 96 to form a lower recess 100 together with lower side edge 72 and ledge support 96. Lower recess 100 opens toward inner wall 68. The angular orientation between lower side edge 72 and ledge supports 96 and 97 results in lower recess 100 being larger than upper recess 98, and allows for a smooth connection between upper and lower coupling members 58 and 60.

As seen in FIGS. 2–5, gasket seal 65 is attached to upper coupling ledge 90, away from inner ledge support 94, on each slat 14. Gasket seal 65 is fused to upper coupling ledge 90 or, alternatively, attached in any acceptable conventional manner. Gasket seal 65 is preferably formed from resilient thermoplastic material and has a generally triangular cross-section such that an end 69 of gasket seal 65 extends into upper recess 98. End 69 is generally pointed in the uncompressed state shown in FIGS. 3 and 4. A side 71 of gasket seal 65 adjacent upper coupling ledge 90 conforms to the shape of upper coupling ledge 90 to form a strong bond therebetween. Gasket seal 65 is sized to fit between upper coupling ledge 90 and lower coupling ledge 92 and second inner ledge support 96, while window 10 is in the closed position such that end 69 is located at and conforms to the point of connection between lower coupling ledge 92 and second inner ledge support 96. End 69 compresses when window 10 is in the closed position to form a substantially air-tight seal between adjacent slats 14, specifically, between each upper coupling ledge 90 and its respective lower coupling ledge 92 and second inner ledge support 96. Gasket seal 65 extends along the entire length of elongated member 56 and provides a secure seal between upper and lower coupling ledges 90 and 92 of adjacent slats 14 along the entire length of each slat 14 when slats 14 are in the closed position.

Gasket seal 65 attached to upper coupling ledge 90 of the top slat 14 provides a seal between upper coupling ledge 90 and inner tip 47 of top member 22. The coupling between inner tip 47, gasket seal 65, and first coupling ledge 90 of top slat 14 is identical to the coupling between adjacent slats 14, as described above.

End caps 62 and 63 are substantially identical except that end caps 62 and 63 are mirror images of each other. Therefore, any discussion concerning one end cap applies equally to the other end cap. Also, the same reference numerals will be used to identify similar parts and/or features of end caps 62 and 63.

As seen in FIGS. 9–12, end caps 62 and 63 have an end wall 102 with inner and outer pivot elements or pins 104 and 106, respectively, extending therefrom. Both pins 104 and 106 extend outwardly and perpendicularly from a frame-facing surface 108 of end wall 102. Slat sealing ribs 116 and 118 also extend perpendicularly from frame-facing surface 108 of end wall 102 for forming a seal between its associate slat 14 and frame sealing ribs 34 of side members 18 and 20 of frame 12. Inner surface 110 of end wall 102 is opposite frame-facing surface 108, and has an inner retaining wall 112 and an outer retaining wall 114 extending perpendicularly therefrom. End wall 102, pins 104 and 106, retaining walls 112 and 114, and slat sealing ribs 116 and 118 are integrally formed as a one-piece, unitary element formed of extruded plastic material, such as PVC.

End cap 63 receives second end edge 76 of elongated member 56 for coupling slat 14 to frame side member 20 and to pivoting mechanism 16. End cap 62, on the other hand, is attached to elongated member 56 at end edge 74 for coupling slat 14 to frame side 18 and top pivoting mechanism 16. Retaining walls 112 and 114 attach end caps 62 and 63 to elongated member 56.

Inner retaining wall 112 is substantially straight along its length. Also, inner retaining wall 112 follows the contour of and is coextensive with both inner wall 68 of elongated member 56 and inner ledge support 94 of upper coupling member 58. Outer retaining wall 114 is curved and follows the contour of and is coextensive with both outer wall 66 of elongated member 56 and outer ledge support 97 of lower coupling member 60. Neither inner retaining wall 112 nor outer retaining wall 114 cover first or second side edges 70 and 72.

Inner and outer retaining walls 112 and 114 are spaced to receive end edges 74 and 76 of elongated member 56 therebetween. As seen in FIG. 12, when end edge 74 and end cap 62 are fully engaged, outer wall 66 of slat 14 abuts outer retaining wall 114 and inner wall 68 abuts inner retaining wall 112. Additionally, end edge 74 will abut inner facing surface 110 of end cap 62. The connection between end cap 62 and end edge 74 is preferably a press fit connection. However, the connection may be made with the use of adhesives, or other conventional fastening techniques, used either singularly or in combination.

As seen in FIGS. 9–12, inner pin 104 is circular in cross-section, is attached to a lobed portion 128 of end wall 102, and is sized to be received by pivoting mechanism 16 as described below. Outer pin 106 is located between and attached to slat sealing ribs 116 and 118 and is circular in cross-section. Outer pin 106 is positioned and sized to be received within one of the apertures 32 in side member 18.

Inner sealing rib 116 is positioned on end wall 102 and extends from upper end 120 of each end cap 62 and 63 to outer pin 106 such that an inner surface 122 of sealing rib 116 extends to and is flush with an outer surface 124 of outer pin 106. Outer slat sealing rib 118 is positioned on end wall 102 such that an outer surface 126 of outer sealing rib 118 extends to and is flush with an outer surface 124 of outer pin 106.

Inner slat sealing rib 116 and outer slat sealing rib 118 are substantially parallel to each other and to inner retaining wall 112. Slat sealing ribs 116 and 118 are sized and positioned to permit frame sealing rib 34 to extend therebetween such that in the closed position (FIG. 2), a tight, abutting connection is made between frame sealing rib 34 and slat sealing ribs 116 and 118. Thus, a seal is provided between frame 12 and slats 14.

As seen in FIGS. 2–4 and 12, pivoting mechanism 16 comprises a pair of U-shaped bars 130 and 131 that extend along the inner surface of side members 18 and 20 for interconnecting slats 14 together. In particular, U-shaped bars 130 and 131 have a plurality of circular openings 132 extending therethrough for receiving inner pins 104 of slat 14. In other words, each of the openings 132 of bars 130 and 132 receives one of the inner pins 104 from one of the slats 14, respectively, and is sized such that inner pin 104 of each slat 14 is freely pivotable within each opening 132. U-shaped bar 130 is located adjacent side member 18, while an identical U-shaped bar 131 is located on the opposite side of slats 14. U-shaped bar 130 interconnects the first ends of slats 14 via inner pins 104 of first end cap 62 in a manner identical to that of U-shaped bar 131 which interconnects the second ends of slats 14 via inner pins 104 of second end cap 63. U-shaped bars 130 and 131 may be formed from extruded plastic material, such as PVC, or alternatively, may be made of other suitable materials, such as metal.

U-shaped bars 130 and 131 are moved by a conventional pivoting apparatus (not shown) for moving slats 14 between the closed position and the open position. Such a pivoting apparatus is disclosed in U.S. Pat. No. 3,110,936 to Berard. U.S. Pat. No. 3,110,936 to Berard is hereby incorporated herein by reference. Specifically, those portions of the Berard patent pertaining to the structure and function of the apparatus for pivoting the lower boards between a closed and an open position are incorporated herein by reference.

Preferably, all elements of frame 12, slats 14, and pivoting mechanism 16 may be formed from extruded plastic materials, such as PVC. The elements of window 10 may be formed of different plastics, or from the same plastic having various characteristics. For example, the frame 12 and pivoting mechanism 16 can be formed from an opaque plastic of one color, while slats 14 can be formed from a translucent plastic of another color.

OPERATION OF WINDOW 10

Figure 5:
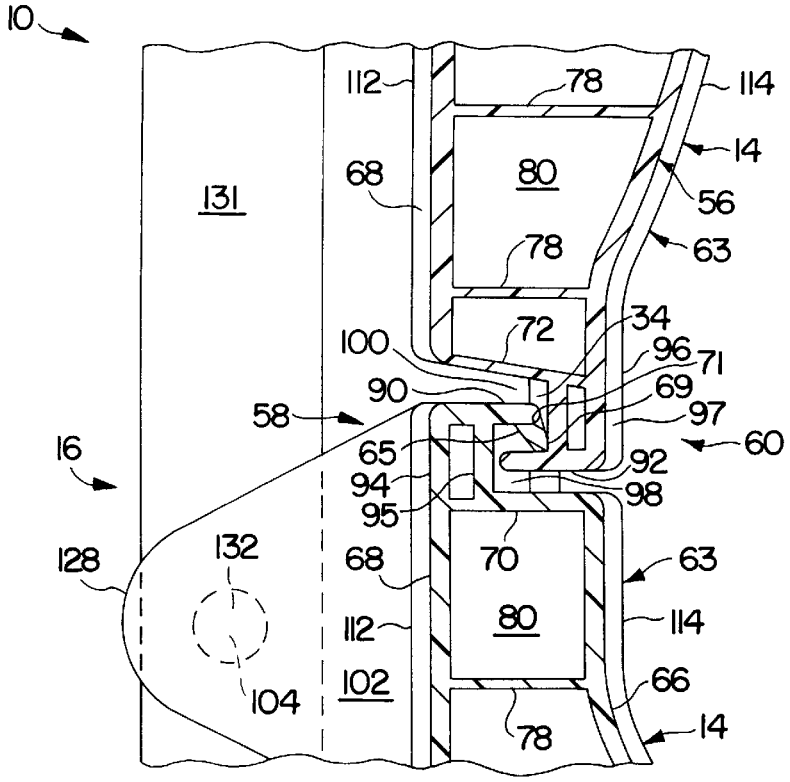
FIG. 5 is an enlarged, partial side elevational view in section similar to FIG. 2, but showing an enlarged view of the connection between adjacent slats.

As seen in FIGS. 2 and 5, the slats 14 are in their closed position to prevent air from passing through window 10. In the closed position, inner walls 68 of each slat 14 are aligned in a vertical plane. Upper coupling member 58 of top slat 14 engages with top member ledge 42 and gasket seal 65, while lower coupling member 60 of top slat 14 engages upper coupling member 58 of adjacent slat 14. Continuing down the length of window 10 to the lowermost or bottom slat 14, each upper coupling member 58 is engaged with an adjacent lower coupling member 60, with gasket seal 65 sealing the space between each of the coupling ledges 90 and 92. Since the lowermost bottom slat 14 is adjacent frame 12, lower coupling member 60 of bottom slat 14 engages bottom sealing ledge 52. Thus, a continuous seal is formed along frame 12 between top member 22 and bottom member 44.

Figure 11:
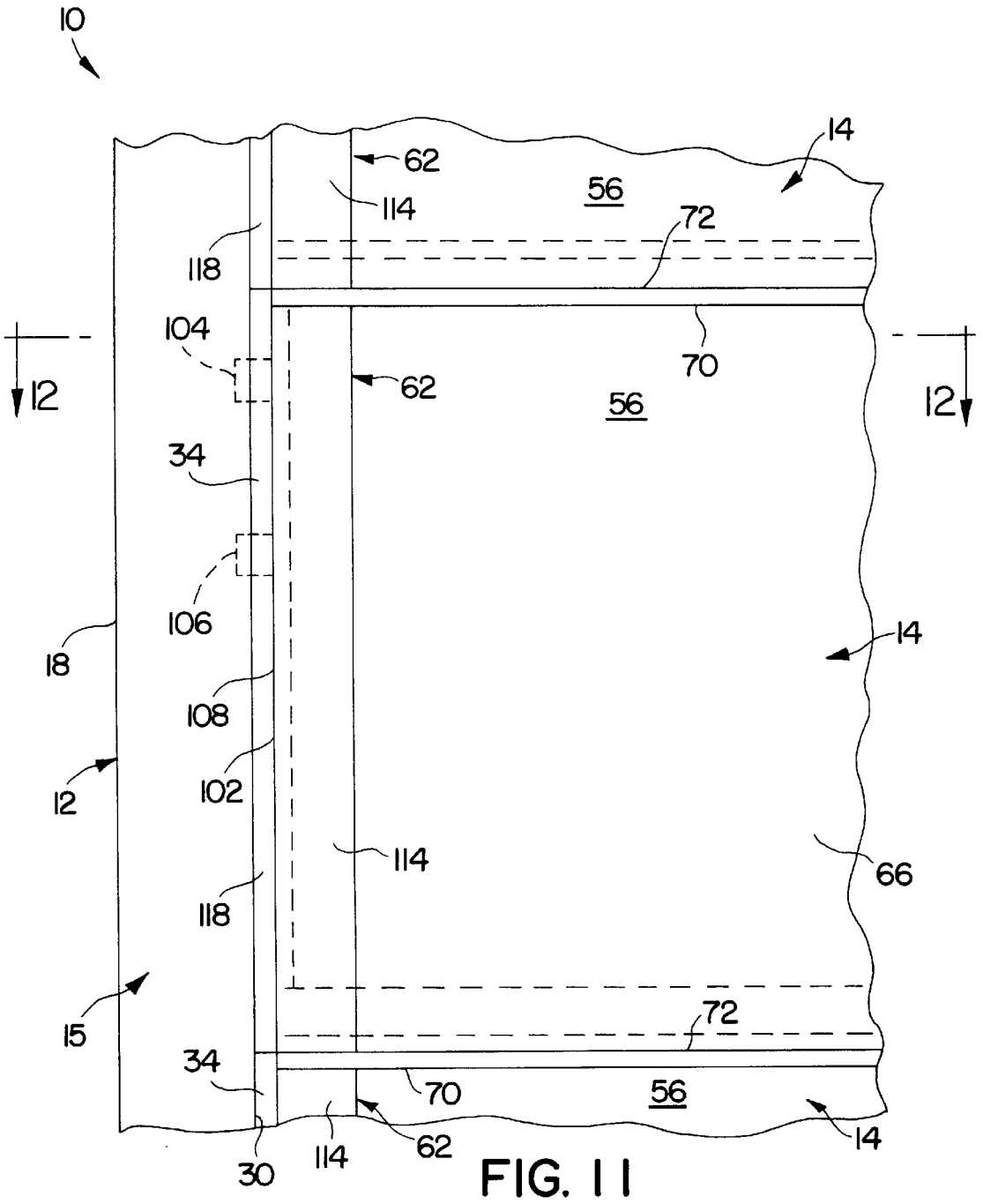
FIG. 11 is an enlarged, partial front elevational view of the louver-type window, in accordance with the present invention, in the closed position.

As seen in FIGS. 11 and 12, frame sealing rib 34 abuts against inner slat sealing rib 116 and outer slat sealing rib 118 to form a continuous seal along the connection between side member 18 of frame 12 and end edge 74 of each slat 14. This seal occurs between each end cap 62 and 63 of each slat 14 and each side member 18 and 20, respectively. Therefore, the seal between slats 14 and side members 18 and 20 is a continuous seal that extends the entire length of side members 18 and 20 between top slat 14 and bottom slat 14. Thus, in the closed position, a complete seal is formed between each slat 14 and between slats 14 and the entire frame 12.

When it is desired to open window 10, the pivoting apparatus is initiated to move U-shaped bars 130 and 131. The movement of bars 130 and 131 is identical, but on opposite sides of window 10. To open window 10, bars 130 and 131 are moved horizontally and vertically from the position shown in FIG. 2 to the position shown in FIG. 3. As bar 131 moves to the position shown in FIG. 3, each slat 14 pivots about outer pin 106 in a counter-clockwise direction relative to FIG. 3, while each inner pin 104 rotates within an opening 132. Also, slat sealing ribs 116 and 118 rotate away from frame sealing rib 34 releasing the seal along the length of frame side members 18 and 20. Since each slat 14 is now separated from its respective adjacent slats 14 and from frame members 22 and 24, light and air are permitted to pass through window 10.

Upon further movement of the pivoting apparatus, bar 131 moves vertically and horizontally from the position shown in FIG. 3 to the position shown in FIG. 4. This movement of bar 131 further pivots each slat 14 about its respective outer pin 104 until each slat 14 is in an open position, oriented 90° from its closed position. In the open position, inner wall 68 of each slat 14 is substantially perpendicular to the longitudinal axis of frame side members 18 and 20, thus allowing an optimal amount of air and light to pass through frame 12.

Although slats 14 have been shown in three positions, the pivoting apparatus and pivoting mechanism 16 will also enable slats 14 to be oriented and maintained indefinitely in any position between the closed position shown in FIG. 2 and the open position shown in FIG. 4. The positions of slats 14 shown in FIGS. 2–4 are for purposes of example only and in no way limit the positioning of slats 14.

When it is desired to close window 10, the process described above is reversed. Through the use of the pivoting apparatus, slats 14 are pivoted in a clockwise direction relative to FIGS. 2–4, from the open position to the closed position.

While advantageous embodiments have been chosen to illustrate the invention, it will be understood by those skilled in the art that various changes and modifications can be made therein without departing from the scope of the invention as defined in the appended claims.

What is claimed is:

1. A slat for pivotally mounting between a pair of opposed frame members of an opening, said slat comprising:

an elongated member having first and second walls which are coupled together to form first and second longitudinally extending side edges and first and second end edges;

first and second coupling members coupled to said first and second side edges, respectively, said first and second coupling members having first and second coupling ledges spaced from said first and second side edges to form first and second longitudinally extending recesses, said first and second longitudinally extending recesses being generally U-shaped in transverse cross-section, each of said first and second recesses receiving an adjacent coupling member on an adjacent slat, respectively, said first recess opening towards said first wall and said second recess opening towards said second wall; and first and second support members coupled to said first and second ends of said elongated member, respectively, each of said first and second support members having a first pivot element, arranged to form a first pivot axis extending longitudinally between said first pivot elements for pivotally mounting said elongated member about said first pivot axis for movement between an open position and a closed position, each of said first and second support members having a second pivot element, said second pivot elements being spaced from said first pivot elements and adapted to receive a pivoting mechanism for moving said support members and said elongated member together about said pivot axis.

2. A slat according to claim 1, wherein each of said first and second support members has a slat sealing rib for abutting against a frame sealing rib.

3. A slat according to claim 1, wherein said elongated member is made from extruded plastic material.

4. A slat according to claim 3, wherein said plastic material is PVC.

5. A slat according to claim 4, wherein said PVC is translucent.

6. A slat according to claim 1, further comprising;

a sealing element located in said first recess and spaced from said elongated member.

7. A slat according to claim 6, wherein said sealing element is fused to said first ledge.

8. A slat according to claim) 7, wherein said sealing element is generally triangular in transverse cross-section, said cross-section having a wide base portion and a narrow tip portion, with said sealing element tapering in thickness between said wide base portion and narrow tip portion.

9. A slat according to claim 8, wherein said first and second longitudinally extending recesses are additionally formed by first and second extensions, respectivly, said first extension extending away from said first side edge in a first direction and having a first attached end and a first free end and said second extension extending away from said second side edge in a second direction which is opposite to said first direction and having a second attached end and a second free end, said first coupling ledge extending from said first free end of said first extension in a third direction which is transverse to said first direction and said second coupling ledge extending from said second free end of said second extension in a fourth direction which is transverse to said second direction, whereby said first recess is formed by said first side edge, said first extension, and said first coupling ledge with said first side edge and said first coupling ledge facing each other and spaced by said first extension, and whereby said second recess is formed by said second side edge, said second extension. and said second coupling ledge with said second side edge and said second coupling ledge facing each other and spaced by said second extension.

10. A slat according to claim 9, wherein said elongated member has at least one interior rib extending between said first and second walls to form first and second interior chambers, and said first and second interior chambers having first and second reinforcing bars positioned therein, respectively, each of said first and second reinforcing bars being distinct and separate elements from said elongated member.

11. A slat according to claim 1, wherein said elongated member has at least one interior rib extending between said first and second walls to form interior chambers, and said first wall being substantially convex and said second wall being substantially planar.

12. A slat according to claim 11, wherein at least one of said interior chambers contains a reinforcing bar.

13. A slat according to claim 11, wherein at least one of said interior :ambers contains an insulating material.

14. A slat according to claim 13, wherein another of said interior chambers contains a reinforcing bar.

15. A slat according to claim 1, wherein said first and second longitudinally extending recesses are additionally formed by first and second extensions, respectively, said first extension extending away from said first side edge in a first direction and having a first attached end and a first free end and said second extension extending away from said second side edge in a second direction which is opposite to said first direction and having a second attached end and a second free end, said first coupling ledge extending from said first free end of said first extension in a third direction which is transverse to said first direction and said second coupling ledge extending from said second free end of said second extension in a fourth direction which is transverse to said second direction, whereby said first recess is formed by said first side edge, said first extension, and said first coupling ledge with said first side edge and said first coupling ledge facing each other and spaced by said first extension, and whereby said second recess is formed by said second side edge, said second extension, and said second coupling ledge with said second side edge and said second coupling ledge facing each other and spaced by said second extension.

16. A slat according to claims 15, further comprising a sealing element located in said first recess and fused to said first ledge and said sealing element being spaced from said first extension and said elongated member.

17. A louver-type window comprising;

a frame having a first pair of substantially parallel, spaced apart side members, each of said first pair of side members having first and second opposite ends;

a plurality of slats extending between said first pair of side members, said plurality of slats having a first slat substantially adjacent said first ends of said first pair of side members of said frame, and a last slat substantially adjacent said second ends of said first pair of side members of said frame, each of said plurality of slats comprising, an elongated member having first and second walls which are coupled together to form first and second longitudinally extending side edges and first and second end edges;

first and second coupling members coupled to said first and second side edges, respectively, said first and second coupling members having first and second slat coupling ledges spaced from said first and second side edges to form first and second longitudinally extending recesses, said first and second longitudinally extending recesses being generally U-shaped in transverse cross-section,k each of said first and second recesses receiving an adjacent slat coupling member on an adjacent slat, respectively, said first recess opening towards said first exterior wall and said second recess opening towards said exterior wall; and first and second support members coupled to said first and second ends of said elongated member, respectively, each of said first and second support members having a first pivot element, arranged to form a first pivot axis extending longitudinally between said first pivot elements for pivotally mounting said elongated member about said first pivot axis for movement between an open position and a closed position; and a pivoting mechanism extending between said first slat and said last slat, said pivoting mechanism being coupled to said support members of said plurality of slats for pivoting each of said plurality of slats relative to said frame between a closed position and an open position, each of said first and second support members having a second pivot element, spaced from its respective said first pivot element and operatively coupled to said pivoting mechanism.

18. A louver-type window according to claim 17, wherein each of said first and second support members has a slat sealing rib, and each of said side members has a frame sealing rib, each of said frame sealing ribs abutting one of said slat sealing ribs, respectively, when said plurality of slats are in said closed position.

19. A louver-type window according to claim 17, wherein said plurality of elongated members are made from extruded plastic material.

20. A louver-type window according to claim 19, wherein said plastic material is PVC.

21. A louver-type window according to claim 20, wherein said PVC is translucent.

22. A louver-type window according to claim 17, wherein said first recesses open in a first direction towards said first wall and said second recesses open in a second direction towards said second wall.

23. A louver-type window according to claim 20, further comprising;

a thermoplastic sealing element located in each of said first recesses and each of said thermoplastic sealing elements being spaced from its respective said elongated member.

24. A louver-type window according to claim 23, wherein each said sealing element is fused to each said first ledge, respectively.

25. A louver-type window according to claim 24, wherein each said sealing element is generally triangular in transverse cross-section. said cross-section having a wide base portion and a narrow tip portion, with said sealing element tapering in thickness between said wide base portion and narrow tip portion.

26. A louver-type window according to claim 25, wherein each of said first and second longitudinally extending recesses are additionally formed by first and second extensions, respectively, said first extension extending away from its respective said first side edge in a first direction and having a first attached end and a first free end and said second extension extending away from its respective said second side edge in a second direction which is opposite to said first direction and having a second attached end and a second free end, each said first coupling ledge extends from its respective said first free end of said first extension in a third direction which is transverse to said first direction and each said second coupling ledge extending from its respective said second free end of said second extension in a fourth direction which is transverse to said second direction, whereby each said first recess is formed by its respective said first side edge, said first extension, and said first coupling ledge with said first side edge and said first coupling ledge facing each other and spaced by said first extension, and whereby each said second recess is formed by its respective said second side edge, said second extension, and said second coupling ledge with said second side edge and said second coupling ledge facing each other and spaced by said second extension.

27. A slat according to claim 26, wherein each of said elongated member has at least one interior rib extending between said first and second walls to form first and second interior chambers, and said first and second interior chambers having first and second reinforcing bars positioned therein, respectively, each of said first and second reinforcing bars being distinct and separate elements from said elongated member.

28. A louver-type window according to claim 17, wherein each of said elongated members further includes at least one interior wall extending between its respective said first and second walls to form hollow interior chambers.

29. A louver-type window according to claim 28, wherein one of said interior chambers contains a reinforcing bar.

30. A louver-type window according to claim 28, wherein at least one of said interior chambers contains an insulating material.

31. A louver-type window according to claim 17, wherein said frame has a second pair of substantially parallel, spaced apart side members, each of said second pair of side members having a side member coupling ledge for receiving an adjacent slat coupling member.

32. A louver-type window according to claim 18, wherein each of said first and second longitudinally extending recesses are additionally formed by first and second extensions, respectively, said first extension extending away from its respective said first side edge in a first direction and having a first attached end and a first free end and said second extension extending away from its respective said second side edge in a second direction which is opposite to said first direction and direction and having a second attached end and a second free end, each said first coupling ledge extends from its respective said first free end of said first extension in a third direction which is transverse to said first direction and each said second coupling ledge extends from its respective said second free end of said second extension in a fourth direction which is transverse to said second direction, whereby each said first recess is formed by its respective said first side edge, said first extension, and said first coupling ledge with said first side edge and said first coupling ledge facing each other and spaced by said first extension, and whereby each said second recess is formed by its respective said second side edge, said second extension, and said second coupling ledge with said second side edge and said second coupling ledge facing each other and spaced by said second extension.

33. A louver-type window according to claim 32, further comprising:

a sealing element located in each said first recess and each sealing element being fused to its respective said first ledge, and each said sealing element being spaced from its respective said first extension and said elongated member.

34. A louver-type window, comprising;

a plastic frame having a first pair of substantially parallel, spaced apart plastic side members, each of said first pair of side members having first and second opposite ends;

a plurality of plastic slats extending between said first pair of side members, said plurality of slats having a first slat substantially adjacent said first ends of said first pair of side members of said frame, and a last slat substantially adjacent said second ends of said first pair of side members of said frame, each of said plurality of slats comprising, a plastic elongated member having first and second walls which are coupled together to form first and second longitudinally extending side edges and first and second end edges;

first and second plastic coupling members coupled to said first and second side edges, respectively, said first and second coupling members forming first and second longitudinally extending recesses, said first and second longitudinally extending recesses being generally U-shaped in transverse cross-section, each of said first and second recesses receiving an adjacent coupling member on an adjacent slat, respectively; and first and second plastic support members coupled to said first and second ends of said elongated member, respectively, each of said first and second support members having a first pivot element, arranged to form a first pivot axis extending longitudinally between said first pivot elements for pivotally mounting said elongated member about said first pivot axis for movement between an open position and a closed position; and a pivoting mechanism extending between said first slat and said last slat, said pivoting mechanism being coupled to said support members of said plurality of slats for pivoting each of said plurality of slats relative to said frame between a closed position and an open position, each of said first and second support members having a second pivot element, spaced from its respective said first pivot element and operatively coupled to said pivoting mechanism.

35. A louver-type window according to claim 34, wherein said plastic is PVC.

36. A louver-type window according to claim 35, wherein said PVC is translucent.

37. A louver-type window according to claim 36, wherein each of said elongated members further includes at least one interior wall extending between its respective said first and second walls to form hollow interior chambers.

38. A louver-type window according to claim 37, wherein one of said interior chambers contains a steel reinforcing bar.

39. A louver-type window according to claim 37, wherein at least one of said interior chambers contains a foamed insulating material.

40. A louver-type window according to claim 39, wherein another of said interior chambers contains a steel reinforcing bar.

41. A louver-type window according to claim 36, further comprising a thermoplastic sealing element located in each of said first recesses and each said sealing element being fused to said respective first coupling member.

42. A slat according to claim) 41, wherein said sealing element is generally triangular in transverse cross-section, said cross-section having a wide base portion and a narrow tip portion, with said sealing element tapering in thickness between said wide base portion and narrow tip portion.

43. A louver-type window according to claim 42, wherein each of said first and second longitudinally extending recesses are formed by first and second extensions, respectively, each said first extension extending away from its respective said first side edge in a first direction and having a first attached end and a first free end and said second extension extending away from its respective said second side edge in a second direction which is opposite to said first direction and having a second attached end and a second free end, each said first coupling ledge extends from its respective said first free end of said first extension in a third direction which is transverse to said first direction and each said second coupling ledge extends from its respective said second free end of said second extension in a fourth direction which is transverse to said second direction, whereby each said first recess is formed by its respective said first side edge, said first extension, and said first coupling ledge with said first side edge and said first coupling ledge facing each other and spaced by said first extension, and whereby each said second recess is formed by its respective said second side edge, said second extension, and said second coupling ledge with said second side edge and said second coupling ledge facing each other and spaced by said second extension.

44. A louver-type window according to claim 43, wherein each said elongated member has at least one interior rib extending between said first and second walls to form first and second interior chambers, and said first and second interior chambers having first and second reinforcing bars positioned therein, respectively, each of said first and second reinforcing bars being distinct and separate elements from said elongated member.

45. A louver-type window according to claim 34, wherein each of said first and second longitudinally extending recesses are formed by first and second extensions, respectively, each said first extension extending away from its respective said first side edge in a first direction and having a first attached end and a first free end and said second extension extending away from its respective said second side edge in a second direction which is opposite to said first direction and having a second attached end and a second free end, each said first coupling ledge extends from its respective said first free end of said first extension in a third direction which is transverse to said first direction and each said second coupling ledge extends from its respective said second free end of said second extension in a fourth direction which is transverse to said second direction, whereby each said first recess is formed by its respective said first side edge. said first extension, and said first coupling ledge with said first side edge and said first coupling ledge facing each other and spaced by said first extension, and whereby each said second recess is formed by its respective said second side edge, said second extension, and said second coupling ledge with said second side edge and said second coupling ledge facing each other and spaced by said second extension.

46. A louver-type window according to claim 45, further comprising:

a thermoplastic sealing element located in each said first recess and each said sealing element fused to said respective said first coupling member, each said sealing member being directly attached to its respective said first coupling ledge of said first coupling member, respectively, and spaced from said first extension and said elongated member, respectively, at least one of said sealing elements directly contacting only said second extension and said second coupling ledge of said second coupling member of said adjacent slat in said closed position.

* * * * *